US005671666A

United States Patent [19]

Wenglar

[11] Patent Number: 5,671,666

[45] Date of Patent: Sep. 30, 1997

[54] CAN RECYCLING APPARATUS

[76] Inventor: Doug Wenglar, P.O. Box 1085, El Campo, Tex. 77437

[21] Appl. No.: 657,738

[22] Filed: May 31, 1996

[51] Int. Cl.[6] ..... B30B 9/32

[52] U.S. Cl. ..... 100/91; 100/156; 100/902; 194/209; 209/223.2; 209/636

[58] Field of Search ..... 100/91, 156, 902; 194/208, 209, 213; 209/223.2, 636, 643

[56] References Cited

U.S. PATENT DOCUMENTS

| | | | |
|---|---|---|---|
| 3,547,577 | 12/1970 | Lovercheck | 100/91 |
| 3,749,240 | 7/1973 | Spears et al. | 209/643 |
| 4,059,050 | 11/1977 | Davis, Jr. | 100/91 |
| 4,179,018 | 12/1979 | Miller | 100/91 |
| 4,241,821 | 12/1980 | Wu et al. | 100/902 |
| 4,257,511 | 3/1981 | Miller | 100/902 |
| 4,316,533 | 2/1982 | Hughes et al. | 100/902 |
| 4,324,325 | 4/1982 | Dewoolfson | 100/902 |
| 4,463,844 | 8/1984 | Huffman et al. | 100/902 |
| 4,480,737 | 11/1984 | Jamgochian et al. | 100/902 |
| 4,483,248 | 11/1984 | Ostreng | 100/902 |
| 4,557,387 | 12/1985 | Frenkel | 209/636 |
| 4,576,289 | 3/1986 | Jarrett et al. | 100/902 |
| 4,653,627 | 3/1987 | Hampson et al. | 100/902 |
| 4,667,832 | 5/1987 | Reinfeld | 100/902 |
| 4,929,342 | 5/1990 | Johnston | 209/643 |
| 4,989,507 | 2/1991 | Rhoades et al. | 100/91 |
| 5,239,920 | 8/1993 | Schuff et al. | 100/91 |
| 5,469,783 | 11/1995 | Fry | 100/91 |

*Primary Examiner*—Stephen F. Gerrity
*Attorney, Agent, or Firm*—Robert C. Curfiss; Butler & Binion, L.L.P.

[57] ABSTRACT

A system for recycling cans includes a housing adapted for displaying promotional advertising, a deposit slot for receiving the cans and a discharge system for providing immediate payment for the recyclable cans. The system incorporates a rotating drum for receiving the cans and advancing the cans into a conduit where they are then transported to a crusher for compression and storage. A magnet associated with the drum maintains ferrous cans on the drum until they have passed the conduit opening for separating ferrous cans from non-ferrous, recyclable cans.

11 Claims, 4 Drawing Sheets

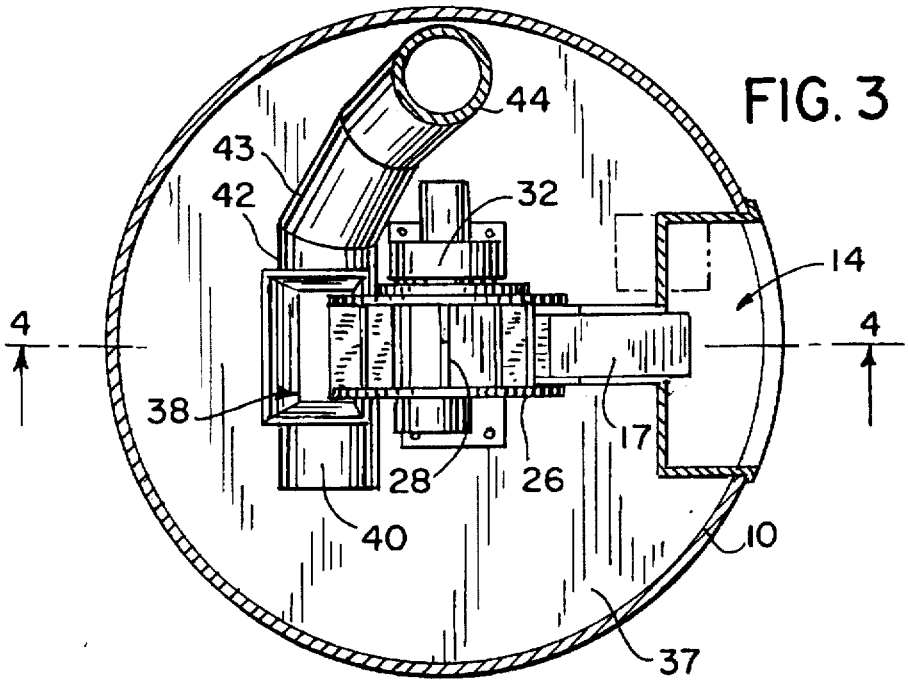
FIG. 3
FIG. 4
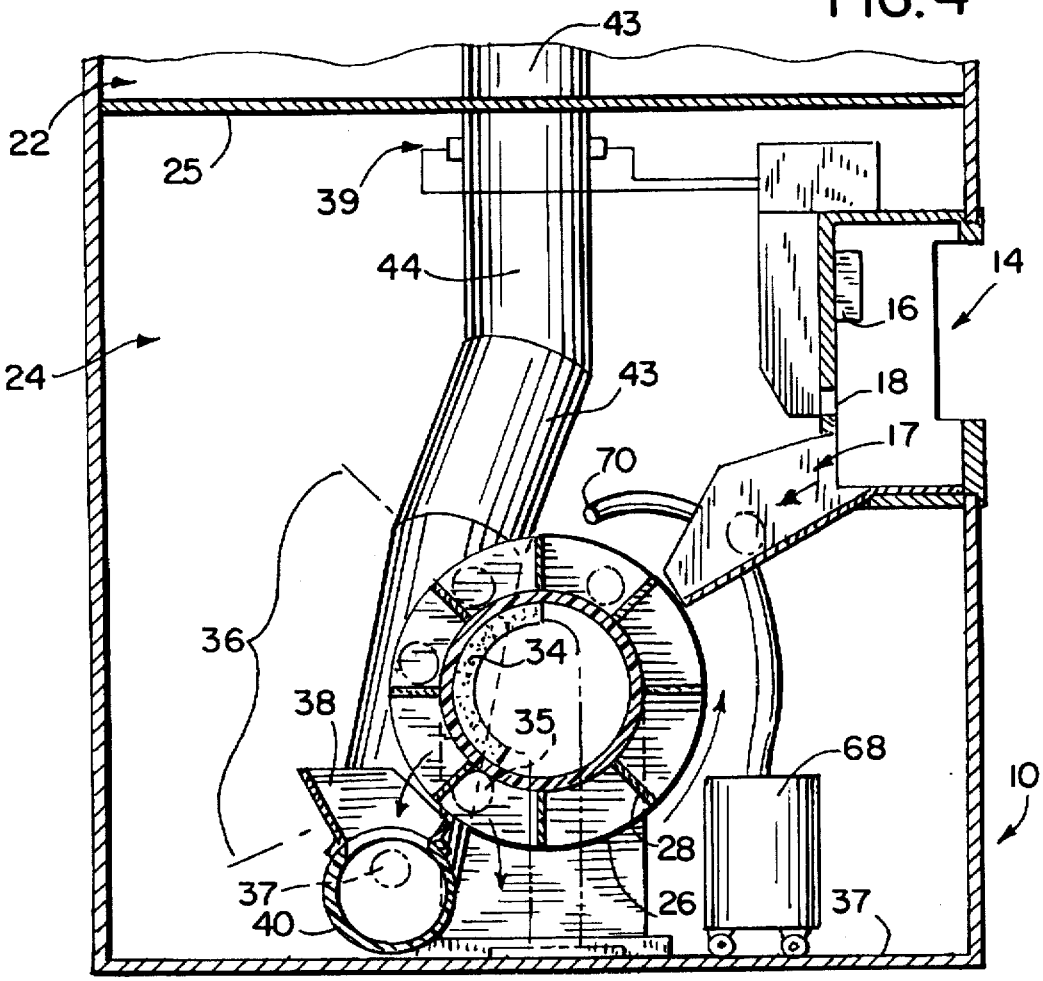

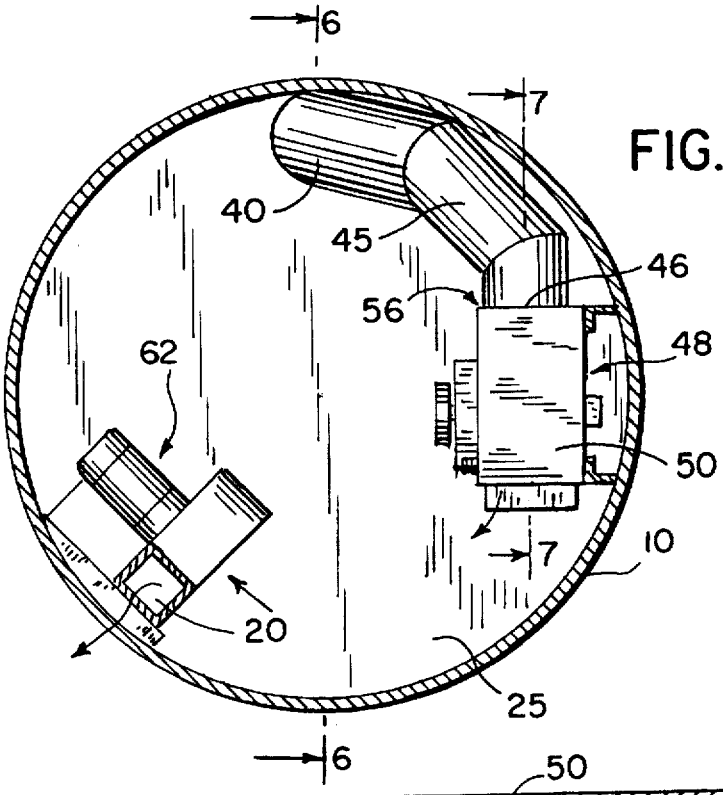
FIG. 5
FIG. 6
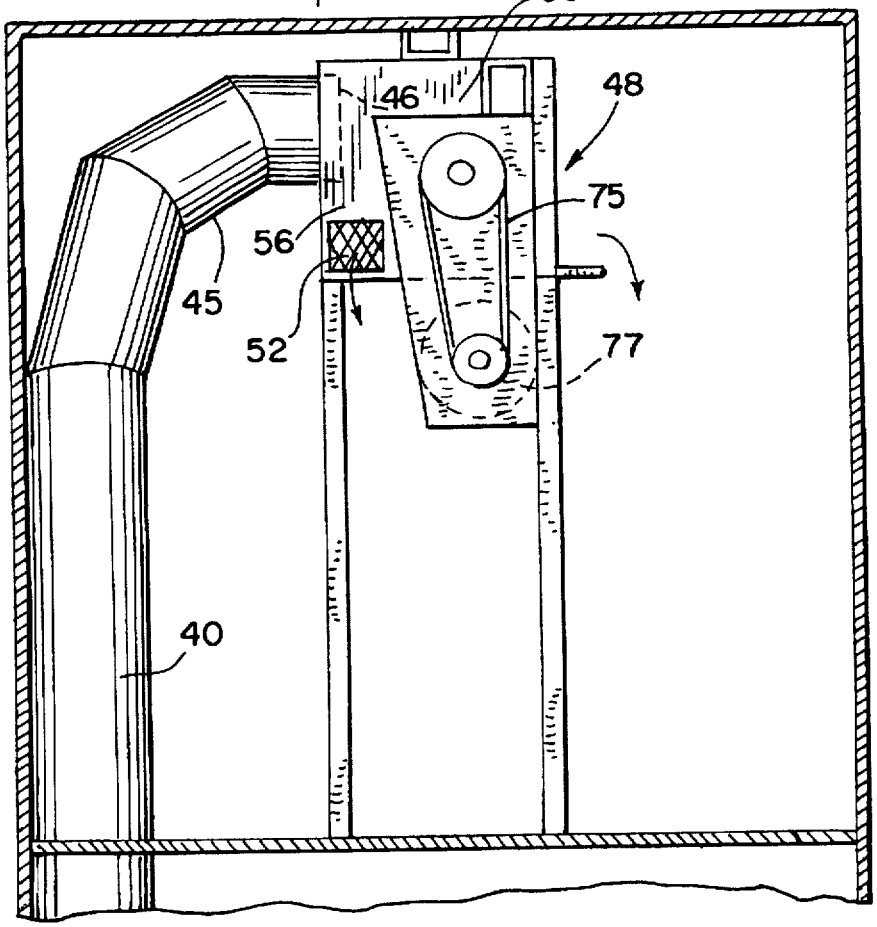

CAN RECYCLING APPARATUS

BACKGROUND OF THE INVENTION

1. Field of the Invention

The subject invention is generally related to recycling systems and is specifically directed to a an automated can recycling system for separating ferrous and non-ferrous cans and for dispensing cash payment immediately upon deposit of the cans in the system.

2. Discussion of the Prior Art

Can separating and crushing apparatus are well known. Typically, cans are deposited into a recycling system containing a moving conveyor for transporting the cans from the point of deposit to a crusher where the cans are crushed for bulk storage and transportation. Intermediately of the point of deposit and the crusher, a magnetic field is provide to separate the ferrous or iron cans from the non-ferrous cans, typically made of aluminum. Such systems have been around for many years.

More recently, in order to encourage recycling, the can separating and crushing apparatus has been housed in a stand alone machine suitable for installation in super market parking lots and the like. The stand alone machine may include an integral cash dispenser for immediately returning cash to an individual when he deposits recyclable cans in the machine. Examples of such apparatus are shown in U.S. Pat. No. 4,989,507; entitled: COLLECTOR FOR EMPTY USED RECYCLABLE BEVERAGE CANS; issued to W. M. Rhoades et al. on Feb. 5, 1991, and U.S. Pat. No. 5,239,920; entitled: CAN CRUSHER APPARATUS; issued to D. A. Schuff et al. on Aug. 31, 1993.

The Rhoades '507 patent discloses a can recycling system incorporating a endless conveyor having a chute for depositing the cans at a start point on the conveyor, and transporting the cans along a horizontal path under two conduit openings under suction draw. The conveyor passes through a magnetic field when in communication with the first conduit opening, whereby ferrous cans are held on the conveyor as the non-ferrous cans are drawn into the first conduit. A second conduit opening is downstream of both the first conduit and the magnetic field, permitting the ferrous cans to be drawn from the conveyor and into the conduit system at the second opening. The cans are then drawn into a crusher. A counter is located in or near the first conduit opening to count the non-ferrous cans as they are drawn from the conveyor. Cash is dispensed based on the number of non-ferrous cans passing from the conveyor into the first conduit opening. One disadvantage to this system is that both the ferrous and non-ferrous cans ultimately enter the conduit system for conveying the cans to the crusher. Gravity is relied upon for re-separating the cans before they enter the crusher. This system has at times proven to be unreliable.

The Schuff '920 patent is an improvement over the earlier systems in that it does not permit the ferrous cans to enter into the conduit system for transporting the non-ferrous cans to the crusher. Specifically, a single conduit opening is in communication with the endless conveyor in the magnetic zone, whereby only the non-magnetic cans are drawn into the conduit system and the magnetic cans drop off of the conveyor outside of the magnetic zone. The remainder of the system is much like the system described in the Rhoades '507 patent.

Additional improvements have been made to such systems, including a device having a separate vacuum system to remove trash and debris from the can flow system. Generally, all such recycling/payout systems continue to rely on the and endless conveyor system to accept the deposited cans and transfer them along a horizontal path to distribute and separate ferrous cans, non-ferrous cans, trash and debris.

Many of the systems now in use are designed to fit in a large cylindrical container, which is intended to resemble a giant can. This permits the container to be decorated or finished with an advertising scheme resembling a can of the sponsor, such as a soft drink can or beer can or the like. This has proven to be an attractive and profitable way to display a recycling system in a retail location such as a shopping center parking lot or the like.

The prior art systems have met with minimum commercial success primarily because of the unreliable nature of the mechanism for collecting and separating the cans having cash value from those that do not. Typically, only aluminum cans can be readily redeemed for cash. Therefore, it is important that the aluminum cans be separated from non-aluminum cans or typically, ferrous cans, and other trash and debris in order to count or weigh the cash value cans to determine the amount of the cash disbursement.

Therefore, there remains a need for a reliable and efficient can collection system for automated point-of-redemption payment systems.

SUMMARY OF THE INVENTION

The subject invention is directed to an improved mechanism for separating redeemable aluminum or non-ferrous cans from non-redeemable ferrous cans. The mechanism is greatly simplified, as is substantially more reliable than the systems of the prior art. The preferred embodiment of the subject invention incorporates a large cylindrical container which is separated into to axially spaced chambers by a solid diametric wall. The lower chamber is adapted for accepting the cans, separating the redeemable cans from the non-redeemable cans, trash and debris and for storing the non-redeemable cans, trash and debris for later disposal. The upper chamber receives the separated redeemable cans and includes a mechanism for counting the cans to determine the amount of the cash payout. The upper chamber also includes a crusher for reducing the volume of the redeemed cans and space for storing the crushed cans for collection and recycling.

In the preferred embodiment, the lower chamber includes a rotating drum for receiving the cans as they are introduced into the system. A light vacuum system is associated with the drum for drawing light trash and debris away from the drum and the cans. As the cans rotate, they pass through a magnetic field for retaining the ferrous cans on the drum while the non-ferrous or aluminum cans fall off the drum into a moving air system for conveying the cans to the crusher. The ferrous cans drop of the drum as it rotates the magnetic field and are collected in the lower chamber for disposal.

In the preferred embodiment, the moving air stream is provided by a conduit system with an opening in communication with the can drop point of the drum. The conduit is in communication with the upper chamber of the container and draws all of the cans in the conduit into the upper chamber. The cans are counted as they are drawn into the upper chamber and are fed into a crusher where they are reduced for storage.

It is an important feature of the subject invention that a single blower is used to draw the cans off of the drum, into the conduit and through the crusher. In the preferred embodiment, the blower is mounted in the ceiling of the container and is exhausted through the roof. This not only makes the design simple, but also preserves the aesthetics while promoting quieter operation of the system at ground level.

The can recycling system of the subject invention provides a novel way to promote recycling while at the same time permitting advertisement of the promoter's products in a unique and eye-catching manner.

It is therefore, an object and feature of the subject invention to provide a system for promotion of recycling by providing immediate cash payout for cans in convenient locations.

It is also an object and feature of the subject invention to provide a unique advertising medium for promoting products.

It is yet another object and feature of the subject invention to provide a can recycling apparatus which is aesthetically pleasing and may be positioned at convenient locations such as retail parking lots and the like.

Other objects and features of the invention will be readily apparent from the attached drawings and detailed description of the preferred embodiment.

BRIEF DESCRIPTION OF THE DRAWING

FIG. 3 is a cross-sectional view taken at line 3—3 of FIG. 2, showing the deposit port, the drum and the transfer conduit.

FIG. 4 is a cross-sectional view of the deposit port, drum and transfer conduit, taken along line 4—4 of FIG. 3.

FIG. 5 is a cross-sectional view taken along 5—5 of FIG. 2, showing the upper chamber.

FIG. 6 is a cross-sectional view taken along line 6—6 of FIG. 5.

DETAILED DESCRIPTION OF THE PREFERRED EMBODIMENT

Figure 1:
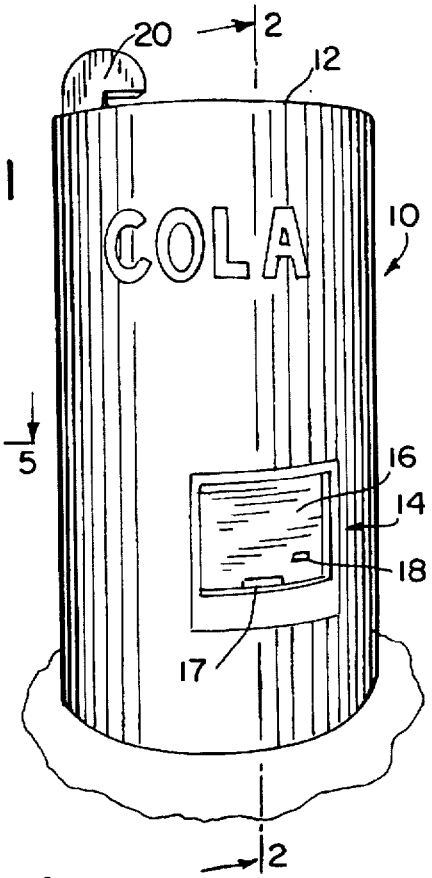
FIG. 1 is a perspective view of the cylindrical container containing the can recycling system of the subject invention.

The exterior cylindrical container or housing 10 for the recycling system of the subject invention is shown in FIG. 1. As shown, the container is a large cylinder with a closed top 12 and a central opening 14 in the front or side for a control panel 16, a deposit slot or port 17 and a cash discharge slot 18. The control system for the recycling machine of the present invention is basically the same as prior art systems and is well within the knowledge of those who are of ordinary skill in the art. Basically, when cans are placed in the deposit slot 17, the system is activated to receive the cans. The cans are separated and an electronic counter keeps track of the number of recyclable cans introduced. At the end of the sequence, the appropriate cash or a redeemable coupon is discharged.

As can be seen, the cylindrical shape of the system makes it readily adaptable for promotional advertisements of beverages, the cylindrical can being capable of being painted to look like the a beverage can. Typically, the cylindrical housing will have a locked, hinged door, or doors (not shown), on the back portion to gain access for maintenance, cleaning or removal of stored, crushed cans.

The exhaust vent 20 for the blower system extends through the roof, as shown in FIG. 1. In the preferred embodiment, the vent is an elbow shape to keep water from leaking into the blower and housing interior.

Figure 2:
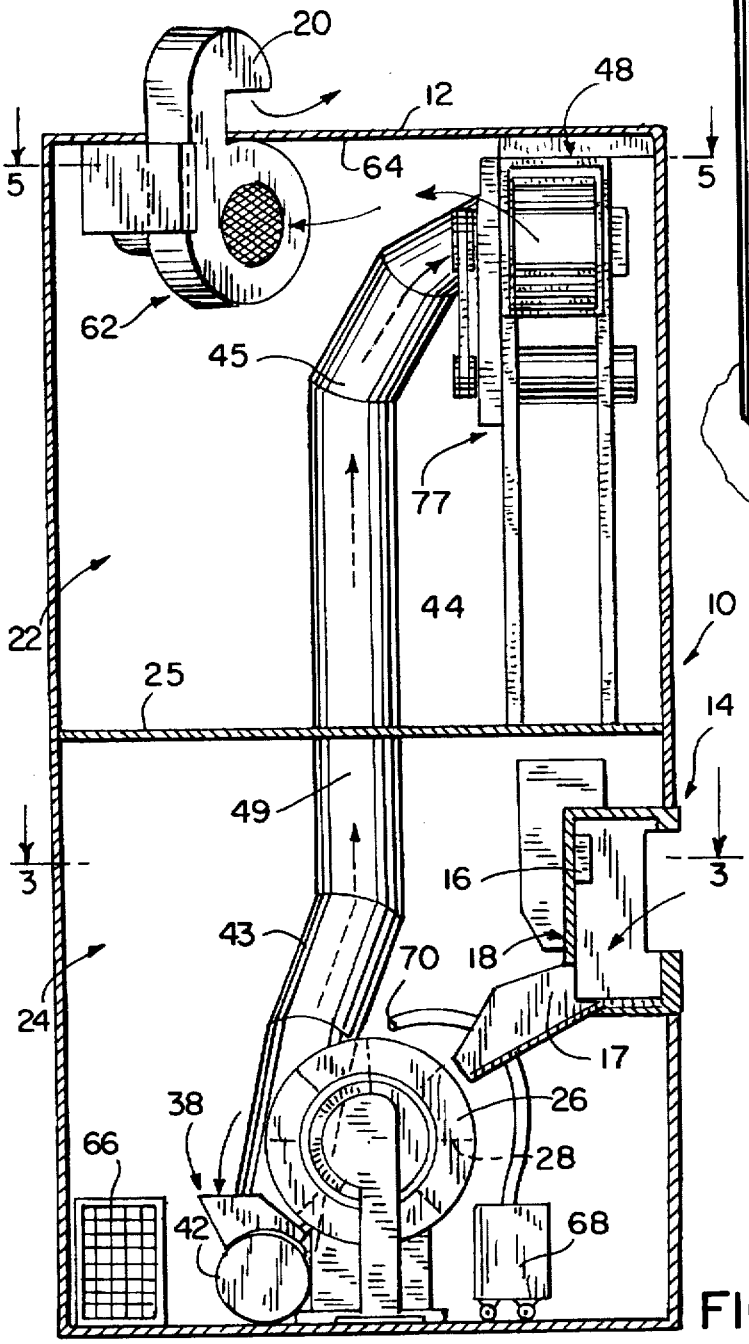
FIG. 2 is a cut-away plan view of the container, showing the upper and lower chambers and the recycling system.

As best seen in FIG. 2, the interior of the container is divided into an upper chamber 22 and a lower chamber 24 by the solid wall 25. The deposit slot 17 is in communication with a rotatable drum 26 adapted for receiving the cans as they are introduced into the lower chamber of the system. The drum is slatted or sectioned by partitions 28, in order to assure advancement of the cans as the drum rotates (in a clockwise direction as shown). A belt driven sprocket (not shown) is attached to the drum and is driven by the electric motor 32 (FIG. 3). The motor is activated when cans are introduced in the slot by breaking an electric eye beam or in any other well known manner.

A permanent magnet 34 is positioned behind the drum, as shown in FIG. 4 and holds ferrous cans 35 on the drum through the magnetic zone 36, as the drum rotates. Aluminum or non-ferrous cans 37 drop off of the drum and into the opening 38 of conduit 40. The ferrous cans 35 stay on the drum until they pass through the magnetic zone 36, after which the cans 35 drop to the floor 37 of the housing 10, as shown.

The conduit 40 extends from the drum 26 in a horizontal reach 42 and then is turned upwardly at 43 to extend vertically along reach 44 and through the wall 24 into the upper chamber 22, terminating near the top or ceiling of the housing in an open elbow 45 (see FIG. 6). The exit port 46 of the elbow is positioned at the mouth 56 of the crusher 48.

Figure 7:
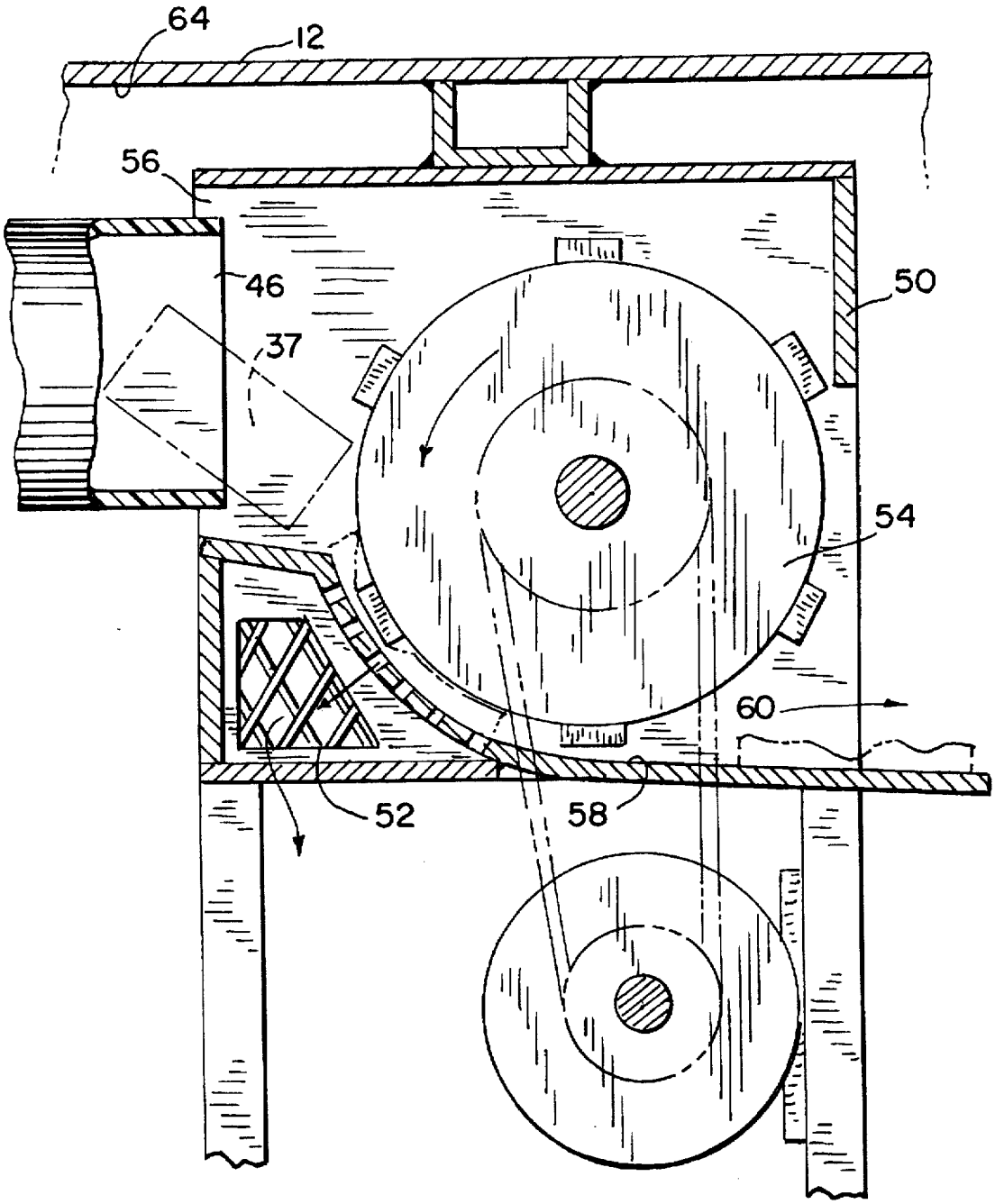
FIG. 7 is a cross-sectional view taken along line 7—7 of FIG. 5.

As best seen in FIG. 7, the crusher includes a housing 50 with a plurality of air ports 52 and a cleated drum 54. As the cans 37 are exited from the port 46 of the elbow, they are drawn into the mouth 56 of the crusher, where they are engaged by the cleated drum 54 and as the drum rotates (clockwise, as drawn) the cans are crushed between the drum and the bottom wall 58 of the crusher, and exited through exit port 60 for storage on the floor defined by wall 25.

A single blower 62 (FIG. 2) is required to draw the cans into the conduit system 40, up into the upper chamber 22 and through the crusher 48. In the preferred embodiment,the blower 62 is mounted in the ceiling 64 of the housing and vented therethrough as at vent 20. The blower draws air into the housing through a screened vent 66 in the lower chamber 24, and into the conduit 40, and exhausts the air through the vent 20.

In operation, when cans are introduced through the deposit slot 14, the drum 26, blower 62 and crusher 48 are activated. These elements will remain activated until the last can introduced into the slot exits the crusher 48. A typical counter mechanism 39 is placed in communication with the conduit 40 to keep count of the cans introduced into the slot in order to calculate the proper cash payment.

In the preferred embodiment, a separate vacuum system 68 may be positioned with or opening 70 to above the drum 26 to draw light trash such as paper debris in the like away from the conduit system 40 in order to keep trash from entering the conduit and the upper chamber. This also minimizes any clogging of the crusher 48.

Also in the preferred embodiment, the crusher housing 50 includes a plurality of small air ports 52 through which air is drawn by the blower 62 in order to enhance the delivery of cans into the mouth of the crusher as they are exited from the exit port 46 of the conduit system 40. This also helps minimize clogging of the crusher. As shown the crusher is belt driven by belt 75 and an independent motor 77. It will be readily understood by those of ordinary skill in the art that other motive means could be utilized without departing from the teachings of the invention.

While certain embodiments and features of the invention have been described in detail herein, it will be readily understood that the invention incorporates all modifications and enhancements within the scope and spirit of the following claims.

What is claimed is:

1. An apparatus for receiving cans, separating recyclable cans from non-recyclable cans, and crushing and storing the recyclable cans, the apparatus comprising:

a. a housing having a deposit port for receiving the cans;

b. a rotatable drum inside the housing and adapted for receiving the cans;

c. a conduit having a first opening in association with the drum and adapted for receiving recyclable cans as they drop off the rotating drum and a second opening remote from the first opening;

d. a magnet associated with a specific zone of the drum for assuring that non-recyclable, ferrous cans do not drop off of the drum and into the conduit;

e. a can crusher in communication with the second opening of the conduit and adapted for receiving recyclable cans exiting from the second opening for crushing and discharging the recyclable cans;

f. a storage chamber in the housing for storing the separated, crushed recyclable cans; and g. an exhaust blower in the housing for drawing air through the first opening and out of the second opening of the conduit and through the crusher for drawing the recyclable cans received from the drum through the conduit and crusher and into the storage chamber.

2. The apparatus of claim 1, wherein the housing includes a lower chamber containing the drum and an upper chamber containing the crusher, the upper chamber adapted for storing the crushed, recyclable cans.

3. The apparatus of claim 2, wherein the conduit extends from the drum in the lower chamber through the wall and into the upper chamber where recyclable are discharged.

4. The apparatus of claim 1, wherein the housing is of cylindrical shape.

5. The apparatus of claim 1, wherein the housing includes a substantially horizontal roof and wherein the blower is exhaust vented through the roof.

6. The apparatus of claim 5, wherein the blower is mounted on the roof of the housing inside the storage chamber.

7. The apparatus of claim 1, further including a screened inlet vent for the blower.

8. The apparatus of claim 1, further including a separate vacuum system associated with the drum for drawing light debris away from the cans thereon.

9. The apparatus of claim 1, wherein the crusher further includes a housing, the housing having a plurality of through ports permitting air flow therethrough for enhancing the flow of recyclable from the conduit to the crusher.

10. The apparatus of claim 1, wherein the crusher includes a cleated crusher drum for engaging and advancing recyclable.

11. The apparatus of claim 1, wherein the drum is slatted for receiving and advancing the cans received from the deposit port.

* * * * *

UNITED STATES PATENT AND TRADEMARK OFFICE

CERTIFICATE OF CORRECTION

PATENT NO. : 5,671,666

DATED : September 30, 1997

INVENTOR(S) : Doug Wenglar

It is certified that error appears in the above-identified patent and that said Letters Patent is hereby corrected as shown below:

| | |
|---|---|
| Claim 3, Line 9 | After Recyclable insert -- cans -- |
| Claim 9, Line 26 | After recyclable insert -- cans -- |
| Claim 10, Line 29 | After recyclable insert -- cans θ- |

Signed and Sealed this

Eighteenth Day of August, 1998

Bruce Lehman

*Attest:*

BRUCE LEHMAN

*Attesting Officer*

*Commissioner of Patents and Trademarks*